US010616685B2

(12) United States Patent
Piechowiak et al.

(10) Patent No.: US 10,616,685 B2
(45) Date of Patent: Apr. 7, 2020

(54) METHOD AND DEVICE FOR STREAMING COMMUNICATION BETWEEN HEARING DEVICES

(71) Applicant: GN HEARING A/S, Ballerup (DK)

(72) Inventors: Tobias Piechowiak, Ballerup (DK); Erik Cornelis Diederik Van Der Werf, Eindhoven (NL); Jonathan Boley, Glenview, IL (US)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 15/815,831

(22) Filed: Nov. 17, 2017

(65) Prior Publication Data

US 2018/0184203 A1 Jun. 28, 2018

(30) Foreign Application Priority Data

Dec. 22, 2016 (EP) ..... 16206243

(51) Int. Cl.
*H04R 5/033* (2006.01)

(52) U.S. Cl.
CPC ..... *H04R 5/033* (2013.01); *H04R 2420/07* (2013.01); *H04R 2460/01* (2013.01)

(58) Field of Classification Search
CPC ..... H04R 5/033; G10K 2210/1081; G10K 2210/3026; G10K 2210/3027; G10K 11/002; G10K 2210/506; G10K 11/17837; G10K 2210/505; A61F 11/14
See application file for complete search history.

(56) References Cited

U.S. PATENT DOCUMENTS

| | | | | |
|---|---|---|---|---|
| 6,421,448 | B1 | 7/2002 | Arndt | |
| 9,826,319 | B2 * | 11/2017 | Kunzle | H04R 25/453 |
| 2008/0063228 | A1 | 3/2008 | Mejia | |
| 2009/0034765 | A1 | 2/2009 | Boillot et al. | |

(Continued)

FOREIGN PATENT DOCUMENTS

| | | | |
|---|---|---|---|
| WO | WO 2008061260 | A2 | 5/2008 |
| WO | WO 2008061260 | A3 | 5/2008 |
| WO | WO 2014194932 | A1 | 12/2014 |

OTHER PUBLICATIONS

Communication pursuant to Article 94(3) dated Nov. 11, 2018 for corresponding European Patent Application No. 16206243.4.

(Continued)

*Primary Examiner* — Mohammad K Islam
(74) *Attorney, Agent, or Firm* — Vista IP Law Group, LLP

(57) ABSTRACT

A hearing device includes: a first input transducer configured to convert an acoustic signal into a first input signal; a processing unit configured to provide a processed signal based on the first input signal; an acoustic output transducer configured to provide an audio output signal of based on the processed signal; a second input transducer configured to provide a second input signal based at least on the audio output signal from the acoustic output transducer and a body-conducted voice signal from a user of the hearing device; and a user voice extraction unit connected to the processing unit for receiving the processed signal, and connected to the second input transducer for receiving the second input signal, wherein the user voice extraction unit is configured to extract a voice signal based at least on the second input signal and the processed signal.

18 Claims, 10 Drawing Sheets

(56) References Cited

U.S. PATENT DOCUMENTS

| | | | | |
|---|---|---|---|---|
| 2009/0147966 | A1 | 6/2009 | McIntosh | |
| 2009/0264161 | A1 | 10/2009 | Usher et al. | |
| 2010/0020995 | A1* | 1/2010 | Elmedyb | H04R 25/453 381/318 |
| 2011/0188685 | A1* | 8/2011 | Sheikh | H04R 25/30 381/318 |
| 2012/0215519 | A1* | 8/2012 | Park | G06F 17/289 704/2 |
| 2014/0126734 | A1* | 5/2014 | Gauger, Jr. | H04R 3/002 381/71.6 |
| 2014/0126756 | A1* | 5/2014 | Gauger, Jr. | A61F 11/14 381/309 |
| 2015/0117660 | A1* | 4/2015 | Fletcher | G10K 11/178 381/72 |
| 2016/0105751 | A1* | 4/2016 | Zurbruegg | H04R 25/407 381/317 |
| 2017/0054528 | A1 | 2/2017 | Pedersen et al. | |
| 2018/0063654 | A1* | 3/2018 | Kuriger | H04R 25/453 |
| 2018/0359554 | A1* | 12/2018 | Razouane | H04R 1/1041 |

OTHER PUBLICATIONS

Narang, Sheya, et al. "Speech Feature Extraction Techniques: A Review." IJCSMC, vol. 4, Issue 3, Mar. 2015, pp. 107-114.

Non-Final Office Action dated Sep. 22, 2017 for related U.S. Appl. No. 15/384,009.

Extended European Search Report dated May 10, 2017 for corresponding EP Patent Application No. 16206243.4, 10 Pages.

Extended European Search Report dated Jun. 1, 2016 for corresponding EP Patent Application No. 15203150.6, 10 Pages.

Communication Pursuant to Article 94 (3) OA dated Apr. 18, 2018 for corresponding European Application No. 16206243.4.

Final Office Action dated Mar. 14, 2018 for related U.S. Appl. No. 15/384,009.

* cited by examiner

METHOD AND DEVICE FOR STREAMING COMMUNICATION BETWEEN HEARING DEVICES

RELATED APPLICATION DATA

This application claims priority to, and the benefit of, European Patent Application No. 16206243.4 filed on Dec. 22, 2016, pending. The entire disclosure of the above application is expressly incorporated by reference herein.

FIELD

The present disclosure relates to a method and a hearing device for audio communication with at least one external device. The hearing device comprises a processing unit for providing a processed first signal, a first acoustic input transducer connected to the processing unit for converting a first acoustic signal into a first input signal to the processing unit for providing the processed first signal, a second input transducer for providing a second input signal, and an acoustic output transducer connected to the processing unit for converting the processed first signal into an audio output signal for the acoustic output transducer.

BACKGROUND

Streaming communication between a hearing device and an external device, e.g. another electronic device, such as another hearing device, is increasing and bears even greater potential for the future, e.g. in connection with hearing protection. However noise in the streamed or transmitted audio signals often decreases the signal quality.

SUMMARY

Thus there is a need for an effective noise cancellation mechanism for external acoustic audio signals while transmitting or streaming communication between devices is enabled. Effective noise cancellation may be provided while the user's own voice is picked up. Furthermore, effective noise cancellation may be provided while also providing two-way communication, where the user's own voice is picked up.

Disclosed is a hearing device for audio communication with at least one external device. The hearing device comprises a processing unit for providing a processed first signal. The hearing device comprises a first acoustic input transducer connected to the processing unit, the first acoustic input transducer being configured for converting a first acoustic signal into a first input signal to the processing unit for providing the processed first signal. The hearing device comprises a second input transducer for providing a second input signal. The hearing device comprises an acoustic output transducer connected to the processing unit, the acoustic output transducer being configured for converting the processed first signal into an audio output signal of the acoustic output transducer. The second input signal is provided by converting, in the second input transducer, at least the audio output signal from the acoustic output transducer and a body-conducted voice signal from a user of the hearing device. The hearing device comprises a user voice extraction unit for extracting a voice signal, where the user voice extraction unit is connected to the processing unit for receiving the processed first signal and connected to the second input transducer for receiving the second input signal. The user voice extraction unit is configured to extract the voice signal based on the second input signal and the processed first signal. The voice signal is configured to be transmitted to the at least one external device.

Also disclosed is a method in a hearing device for audio communication between the hearing device and at least one external device. The hearing device comprises a processing unit, a first acoustic input transducer, a second input transducer, an acoustic output transducer and a user voice extraction unit. The method comprises providing a processed first signal in the processing unit. The method comprises converting a first acoustic signal into a first input signal, in the first acoustic input transducer. The method comprises providing a second input signal, in the second input transducer. The method comprises converting the processed first signal into an audio output signal in the acoustic output transducer. The second input signal is provided by converting, in the second input transducer, at least the audio output signal from the acoustic output transducer and a body-conducted voice signal from a user of the hearing device. The method comprises extracting a voice signal, in the user voice extraction unit, based on the second input signal and the processed first signal. The method comprises transmitting the extracted voice signal to the at least one external device.

The hearing device and method as disclosed provides an effective noise cancellation mechanism for external acoustic audio signals while transmitting or streaming communication is enabled, at least from the hearing device to the external device.

The hearing device and method allow transmitting or streaming communication between two hearing devices, such as between two hearing devices worn by two users. Thus the voice of the user of the first hearing device can be streamed to the hearing device of the second user such that the second user can hear the voice of the first user and vice versa.

At the same time the hearing device excludes external sounds from entering the audio loop in the hearing devices, thus the user of the second hearing device does not receive noise from the surroundings of the first user, as the external noise at the first user is removed and/or filtered out.

Thus the voice of the user of the first hearing device is transmitted or streamed as audio to the second hearing device while the surrounding noise is removed. The user of the first hearing device may also receive transmitted or streamed audio from the second hearing device or from another external device while surrounding noise at the user of the first hearing device is cancelled out.

Surrounding noise can be cancelled out due to the provision of the first acoustic input transducer, e.g. an outer microphone in the hearing device, which may work as reference microphone for eliminating the sound from the surroundings of the user of the hearing device.

The hearing device may also prevent, eliminate and/or remove the occlusion effect for the user of the hearing device. This is due to the provision of the second input transducer, e.g. an in-canal input transducer, such as a microphone in the ear canal of the user.

The hearing device may be configured to cancel the acoustic signals. A first transmitted or streamed signal to the hearing device, e.g. from the at least one external device or from another external device, and the body-conducted voice signal, or possibly almost the entire part of the body-conducted voice signal being a vibration signal, may be outside the acoustic processing loop in the hearing device. Thus a first transmitted or streamed signal and the body-conducted, e.g. vibration, voice signal may be kept and maintained in the hearing device and not cancelled out.

The hearing device may be a hearing aid, a binaural hearing device, an in-the-ear (ITE) hearing device, an in-the-canal (ITC) hearing device, a completely-in-the-canal (CIC) hearing device, a behind-the-ear (BTE) hearing device, a receiver-in-the-canal (RIC) hearing device etc. The hearing device may be a digital hearing device. The hearing device may be a hands-free mobile communication device, a speech recognition device etc. The hearing device or hearing aid may be configured for or comprise a processing unit configured for compensating a hearing loss of a user of the hearing device or hearing aid.

The hearing device is configured for audio communication with at least one external device. The hearing device is configured to be worn in the ear of the hearing device user. The hearing device user may wear a hearing device in both ears or in one ear. The at least one external device may be worn, carried, held, attached to, be adjacent to, in contact with, connected to etc. another person than the user. The other person being associated with the external device is in audio communication with the user of the hearing device. The at least one external device is configured to receive the extracted voice signal from the hearing device. Thus the person associated with the at least one external device is able to hear what the user of the hearing device says, while the surrounding noise at the user of the hearing device is cancelled or reduced. The voice signal of the user of the hearing device is extracted in the user voice extraction unit such that the noise present at the location of the hearing device user is cancelled or decreased when the signal is transmitted to the at least one external device.

The audio communication may comprise transmitting signals from the hearing device. The audio communication may comprise transmitting signals to the hearing device. The audio communication may comprise receiving signals from the hearing device. The audio communication may comprise receiving signals from the at least one external device. The audio communication may comprise transmitting signals from the at least external device. The audio communication may comprise transmitting signals between the hearing device and the at least one external device, such as transmitting signals to and from the hearing device and such as transmitting signal to and from the at least one external device.

The audio communication can be between the hearing device user and his or her conversation partner, such as a spouse, family member, friend, colleague etc. The hearing device user may wear the hearing device for being compensated for a hearing loss. The hearing device user may wear the hearing device as a working tool, for example if working in a call centre or having many phone calls each days, or if being a soldier and needing to communicate with colleague soldiers or execute persons giving orders or information.

The at least one external device may be a hearing device, a telephone, a phone, a smart phone, a computer, a tablet, a headset, a device for radio frequency communication etc.

The hearing device comprises a processing unit for providing a processed first signal. The processing unit may be configured for compensating for a hearing loss of the hearing device user. The processed first signal is provided at least to the acoustic output transducer.

The hearing device comprises a first acoustic input transducer connected to the processing unit for converting a first acoustic signal into a first input signal to the processing unit for providing the processed first signal. The first acoustic input transducer may be a microphone. The first acoustic input transducer may be an outer microphone in the hearing device, e.g. a microphone arranged in or on or at the hearing device to receive acoustic signals from outside the hearing device user, such as from the surroundings of the hearing device user. The first acoustic signal received in the first acoustic input transducer may be acoustic signals, such as sound, such as ambient sounds present in the environment of the hearing device user. If the hearing device user is present in an office space, then the first acoustic input signal may be the voices of co-workers, sounds from office equipment, such as from computers, keyboards, printers, coffee machines etc. If the hearing device user is for example a soldier present in a battle field, then the first acoustic signal may be sounds from war materials, voices from soldier colleagues etc.

The first acoustic signal is an analogue signal provided to the first acoustic input transducer. The first input signal is a digital signal provided to the processing unit. An analogue-to-digital converter (A/D converter) may be arranged between the first acoustic input transducer and the processing unit for converting the analogue signal from the first acoustic input transducer to a digital signal to be received in the processing unit. The processing unit provides the processed first signal.

A pre-processing unit may be provided before the processing unit for pre-processing the signal before it enters the processing unit. A post-processing unit may be provided after the processing unit for post-processing the signal after it leaves the processing unit.

The hearing device comprises a second input transducer for providing a second input signal. The second input transducer may be an inner input transducer arranged in the ear, such as in the ear canal, of the hearing device user, when the hearing device is worn by the user.

The hearing device comprises an acoustic output transducer connected to the processing unit for converting the processed first signal into an audio output signal for the acoustic output transducer. The acoustic output transducer may be loudspeaker, a receiver, a speaker etc. The acoustic output transducer may be arranged in the ear, such as in the ear canal of the user of the hearing device, when the hearing device is worn by the user. A digital-to-analogue converter (D/A converter) may be arranged between the acoustic output transducer and the processing unit for converting the digital signal from the processing unit to an analogue signal to be received in the acoustic output transducer. The audio output signal provided by the acoustic output transducer is provided to the second input transducer.

The second input signal is provided by converting, in the second input transducer, at least the audio output signal from the acoustic output transducer and a body-conducted voice signal from a user of the hearing device. The second input transducer may receive more signals than the audio output signal and the body-conducted voice signal. Thus the second input signal may be provided by converting more signal than the audio output signal and the body-conducted voice signal. For example the first acoustic signal may also be provided to the second input transducer and thus the first acoustic input signal may be used to provide the second input signal. Thus the first acoustic signal may be received in both the first acoustic input transducer and in the second input transducer.

Thus the second input transducer is configured to receive both the audio output signal from the acoustic output transducer and the body-conducted voice signal from the user of the hearing device.

The body-conducted voice signal may be a spectrally modified version of the voice or speech signal that emanates from the mouth of the user.

The hearing device comprises a user voice extraction unit for extracting a voice signal. The user voice extraction unit is connected to the processing unit for receiving the processed first signal. The user voice extraction unit is also connected to the second input transducer for receiving the second input signal. The user voice extraction unit is configured to extract the voice signal of the user based on the second input signal and the processed first signal. When the voice signal is extracted, it is configured to be transmitted to the at least one external device. The extracted voice signal of the user is an electrical signal, not an acoustic signal.

An analogue-to-digital converter (A/D converter) may be arranged between the second input transducer and the user voice extraction unit for converting the analogue signal from the second input transducer to a digital signal to be received in the user voice extraction unit.

The audio signals arriving at the second input transducer, which is for example an inner input transducer, may be almost only consisting of the body-conducted voice signal, as the filtering in the hearing device, see below, may remove almost entirely the audio output signal from the acoustic output transducer. Thus the audio output signal from the acoustic output transducer may be removed by filtering before entering the second input transducer. The audio output signal from the acoustic output transducer may consist primarily of the first acoustic signal received in the first input transducer.

In some embodiments the body-conducted voice signal emanates from the mouth and throat of the user and is transmitted through bony structures, cartilage, soft-tissue, tissue and/or skin of the user to the ear of the user and is configured to be picked-up by the second input transducer. The body-conducted voice signal may be an acoustic signal. The body-conducted voice signal may be a vibration signal. The body-conducted voice signal may be a signal which is a combination of an acoustic signal and a vibration signal. The body-conducted voice signal may be a low frequency signal. The corresponding voice signal not conducted through the body but only or primarily conducted through the air may be a higher frequency signal. The body-conducted voice signal may have more low-frequency energy and less high-frequency energy than the corresponding voice signal outside the ear canal, i.e. than the voice signal not conducted through the body but only or primarily conducted through the air. The body-conducted voice signal may have a different spectral content than a corresponding voice signal which is not conducted through the body but only conducted through air. The body-conducted voice signal may be conducted through both the body of the user and through air. The body-conducted voice signal is not a bone-conducted signal, such as a pure bone-conducted signal. The body-conducted signal is to be received in the ear canal of the user of the hearing device by the second input transducer. The body-conducted voice signal is transmitted through the body of the user from the mouth and throat of the user where the voice or speech is generated. The body-conducted voice signal is transmitted through the body of the user by the user's bones, bony-structures, cartilage, soft-tissue, tissue and/or skin. The body-conducted voice signal is transmitted at least partly through the material of the body, and the body-conducted voice signal may thus be at least partly a vibration signal. As there may also be air cavities in the body of the user, the body-conducted voice signal may also be at least a partly air-transmitted signal, and the body-conducted voice signal may thus be at least partly an acoustic signal.

In some embodiments the second input transducer is configured to be arranged in the ear canal of the user of the hearing device. The second input transducer may be configured to be arranged completely in the ear canal.

In some embodiments the second input transducer is a vibration sensor and/or a bone-conduction sensor and/or a motion sensor and/or an acoustic sensor. The second input transducer may be a combination of one or more sensors, such as a combination of one or more of a vibration sensor, a bone-conduction sensor, a motion sensor and an acoustic sensor. As an example the second input transducer may be a vibration sensor and an acoustic input transducer, such as a microphone, configured to be arranged in the ear canal of the user.

In some embodiments the first acoustic input transducer is configured to be arranged outside the ear canal of the user of the hearing device, and the first acoustic input transducer may be configured to detect sounds from the surroundings of the user. The first acoustic input transducer may point in any direction and thus may pick up sounds coming from any direction. The first acoustic input transducer may for example be arranged in a faceplate of the hearing device, for example for a completely-in-the-canal (CIC) hearing device and/or for an in-the-ear (ITE) hearing device. The first acoustic input transducer may for example be arranged behind the ear of the user for a behind-the-ear (BTE) hearing device and/or for a receiver-in-the-canal (RIC) hearing device.

In some embodiments a first transmitted signal is provided to the hearing device from the at least one external device, and the first transmitted signal may be included in the first processed signal and in the second input signal provided to the user voice extraction unit for extracting the voice signal. The first transmitted signal may be a streamed signal. The first transmitted signal may be from another hearing device, from a smart phone, from a spouse microphone, from a media content device, from a TV streaming etc. The first transmitted signal may be from the at least one external device and/or from another external device. The first transmitted signal may be one signal from one device and/or may be a combination of more signals from more devices, e.g. both a signal from a phone call and a signal from a media content etc. Thus the first transmitted signal may be or comprise multiple input signals from multiple external devices. The first transmitted signal can be a mixture of different signals. The first transmitted signal may be a first streamed signal. If the first transmitted signal is transmitted from the at least one external device, e.g. a first external device, then the hearing device is configured for transmitting to and from the same external device. If the first transmitted signal is transmitted from another external device, e.g. a second external device, then the hearing device is configured for transmitting to and from different external devices. The first transmitted signal may be provided to the hearing device, for example added before the processing unit, at the processing unit and/or after the processing unit. In an example the first transmitted signal is added after the processing unit and before the acoustic output transducer and user voice extraction unit.

In some embodiments the user voice extraction unit comprises a first filter configured to cancel the audio output signal from the second input signal. The second input signal is provided by converting, in the second input transducer, at least the audio output signal from the acoustic output transducer and a body-conducted voice signal from a user of the hearing device. Thus the second input signal comprises a part originating from the audio output signal from the acoustic output transducer and a part originating from the body-conducted voice signal of the user. Thus when the audio output signal is cancelled from the second input signal in the first filter of the user voice extraction unit, then the body-conducted voice signal remains and can be extracted to the external device. The first filter may be an adaptive filter or a non-adaptive filter. The first filter may be running at a baseband sample rate, and/or at a higher rate.

In some embodiments the hearing device comprises a voice processing unit for processing the extracted voice signal based on the extracted voice signal and/or the first input signal before transmitting the extracted voice signal to the at least one external device. Thus before transmitting the extracted voice signal, this extracted voice signal is processed based on itself, as received from the voice extraction unit, and based on the first input signal from the first acoustic input transducer. The first input signal from the first acoustic input transducer may be used in the voice processing unit for filtering out sounds/noise from the surroundings, which may be received by the first acoustic input transducer, which may be an outer reference microphone in the hearing device. This embodiment may be used or may be relevant when two users, each wearing a hearing device, are in audio communication with each other.

In some embodiments the voice processing unit comprises at least a second filter configured to minimize any portion of the first acoustic signal present in the extracted voice signal. The first acoustic signal may be the sounds or noise from the surroundings of the user received by the first acoustic input transducer, which may be an outer reference microphone. When the portion of the first acoustic signal in the extracted voice signal is minimized, the sounds or noise from the surroundings of the user received by the first acoustic input transducer, which may be an outer reference microphone, is minimized, whereby this sound or noise from the surroundings may not be transmitted to the external device. This is an advantage as the user of the external device then receives primarily the voice signal from the user of the hearing device, and does not receive the surrounding sounds or noise from the environment of the user of the hearing device. The second filter may be configured to cancel and/or reduce any portion of the first acoustic signal present in the extracted voice signal. The second filter may be an adaptive filter or a non-adaptive filter. The second filter may be running at a baseband sample rate, and/or at a higher rate. If the second filter is an adaptive filter, a voice activity detector may be provided. The second filter may comprise a steep low-cut response to cut out very low frequency energy, such as very low frequency energy from e.g. walking, jaw motion, etc. of the user.

In some embodiment the voice processing unit comprises a spectral shaping unit for shaping the spectral content of the extracted voice signal to have a different spectral content than the body-conducted voice signal. The body-conducted voice signal may be a spectrally modified version of the voice or speech signal that emanates from the mouth of the user, as the body-conducted voice signal is conducted through the material of the body of the user. Thus in order to provide that the body-conducted voice signal has a spectral content which resembles a voice signal emanating from the mouth of the user, i.e. conducted through air, the spectral content of the extracted voice signal may be shaped or changed accordingly. The spectral shaping unit may be a filter, such as a third filter, which may be an adaptive filter or a non-adaptive filter. The spectral shaping unit or third filter may be running at a baseband sample rate, and/or at a higher rate.

In some embodiments the voice processing unit comprises a bandwidth extension unit configured for extending the bandwidth of the extracted voice signal.

In some embodiments the voice processing unit comprises a voice activity detector configured for turning on/off the voice processing unit, and wherein the extracted voice signal is provided as input to the voice activity detector. The voice activity detector may provide enabling and/or disabling of any adaptation of filters, such as the first filter, the second filter and/or the third filter.

In some embodiments the extracted voice signal is provided by further converting, in the second input transducer, the first acoustic signal. Thus besides receiving the first acoustic signal in the first acoustic input transducer, the first acoustic signal is also received in the second input transducer. Accordingly the first acoustic signal may form part of the second input signal, and thus the first acoustic signal may form part of the extracted voice signal.

According to an aspect, disclosed is a binaural hearing device system comprising a first and a second hearing device, wherein the first and/or second hearing device is a hearing device according to any of the aspects and/or embodiments disclosed above and in the following. The extracted voice signal from the first hearing device is a first extracted voice signal. The extracted voice signal from the second hearing device is a second extracted voice signal. The first extracted voice signal and/or the second extracted voice signal are configured to be transmitted to the at least one external device. The first extracted voice signal and the second extracted voice signal are configured to be combined before being transmitted. The first hearing device is configured to the inserted in one of the ears of the user, such as the left ear or the right ear. The second hearing device is configured to be inserted in the other ear of the user, such as the right ear or the left ear, respectively.

Throughput the description, the terms hearing device and head-wearable hearing device may be used interchangeably. Throughput the description, the terms external device and far end recipient or far recipient may be used interchangeably. Throughput the description, the terms processing unit and signal processor may be used interchangeably. Throughput the description, the terms processed first signal and processed output signal may be used interchangeably. Throughput the description, the terms first acoustic input transducer and ambient microphone may be used interchangeably. Throughput the description, the terms first acoustic signal and environmental sound may be used interchangeably. Throughput the description, the terms first input signal and microphone input signal may be used interchangeably. Throughput the description, the terms second input transducer and ear canal microphone may be used interchangeably. Throughput the description, the terms second input signal and electronic ear canal signal may be used interchangeably. Throughput the description, the terms acoustic output transducer and loudspeaker or receiver may be used interchangeably. Throughput the description, the terms audio output signal and acoustic output signal may be used interchangeably. Throughput the description, the terms user voice extraction unit and compensation summer with/plus/including compensation filter may be used interchangeably. Throughput the description, the terms extracted voice signal and hybrid microphone signal may be used interchangeably.

Acquiring a clean speech signal is of considerable interest in numerous two-way communication applications using a variety of head-wearable hearing devices such as headsets, active hearing protectors and hearing instruments or aids.

The clean speech signal, such as the extracted voice signal, supplies a far end recipient, receiving the clean speech signal through a wireless data communication link, with a more intelligible and comfortably sounding speech signal. The clean speech signal typically provides improved speech intelligibly and better comfort for the far recipient e.g. during a phone conversation.

However, sound environments in which the user of the head-wearable hearing device is situated are often corrupted or infected by numerous noise sources such as interfering speakers, traffic, loud music, machinery etc. leading to a poor signal-to-noise ratio of a target sound signal arriving at an ambient microphone of the hearing device. This ambient microphone may be sensitive to sound arriving at all directions from the user's sound environment and hence tends to indiscriminately pick-up all ambient sounds and transmit these as a noise-infected speech signal to the far end recipient. While these environmental noise problems may be mitigated to a certain extent by using an ambient microphone with certain directional properties or using a so-called boom-microphone (typical for headsets), there is a need in the art to provide head-wearable hearing device with improved signal quality, in particular improved signal-to-noise ratio, of the user's own voice as transmitted to far-end recipients over the wireless data communication link. The latter may comprise a Bluetooth link or network, Wi-Fi link or network, GSM cellular link etc.

The present head-wearable hearing device detects and exploits a bone conducted component of the user's own voice picked-up in the user's ear canal to provide a hybrid speech/voice signal with improved signal-to-noise ratio under certain sound environmental conditions for transmission to the far end recipient. The hybrid speech signal may in addition to the bone conducted component of the user's own voice also comprise a component/contribution of the user's own voice as picked-up by an ambient microphone arrangement of the head-wearable hearing device. This additional voice component derived from the ambient microphone arrangement may comprise a high frequency component of the user's own voice to at least partly restore the original spectrum of the user's voice in the hybrid microphone signal.

A first aspect relates to a head-wearable hearing device comprising: an ambient microphone arrangement configured to receive and convert environmental sound into a microphone input signal, a signal processor adapted to receive and process the microphone input signal in accordance with a predetermined or adaptive processing scheme for generating an processed output signal, a loudspeaker or receiver adapted to receive and convert the processed output signal into a corresponding acoustic output signal to produce ear canal sound pressure in a user's ear canal, an ear canal microphone configured to receive and for convert the ear canal sound pressure into an electronic ear canal signal, a compensation filter connected between the processed output signal and a first input of a compensation summer, wherein the compensation summer is configured to subtracting the processed output signal and the electronic ear canal signal to produce a compensated ear canal signal for suppression of environmental sound pressure components. The head-wearable hearing device furthermore comprises a mixer configured to combine the compensated ear canal signal and the microphone input signal to produce a hybrid microphone signal; and a wireless or wired data communication interface configured to transmit the hybrid microphone signal to a far end recipient through a wireless or wired data communication link.

The head-wearable hearing device may comprise different types of head-worn listening or communication devices such as a headset, active hearing protector or hearing instrument or hearing aid. The hearing instrument may be embodied as an in-the-ear (ITE), in-the-canal (ITC), or completely-in-the-canal (CIC) aid with a housing, shell or housing portion shaped and sized to fit into the user's ear canal. The housing or shell may enclose the ambient microphone, signal processor, ear canal microphone and the loudspeaker. Alternatively, the present hearing instrument may be embodied as a receiver-in-the-ear (RIC) or traditional behind-the-ear (BTE) aid comprising an ear mould or plug for insertion into the users ear canal. The BTE hearing instrument may comprise a flexible sound tube adapted for transmitting sound pressure generated by a receiver placed within a housing of the BTE aid to the users ear canal. In this embodiment, the ear canal microphone may be arranged in the ear mould while the ambient microphone arrangement, signal processor and the receiver or loudspeaker are located inside the BTE housing. The ear canal signal may be transmitted to the signal processor through a suitable electrical cable or another wired or unwired communication channel. The ambient microphone arrangement may be positioned inside the housing of the head-worn listening device. The ambient microphone arrangement may sense or detect the environmental sound or ambient sound through a suitable sound channel, port or aperture extending through the housing of the headworn listening device. The ear canal microphone may have a sound inlet positioned at a tip portion of the ITE, ITC or CIC hearing aid housing or at a tip of the ear plug or mould of the headset, active hearing protector or BTE hearing aid, preferably allowing unhindered sensing of the ear canal sound pressure within a fully or partly occluded ear canal volume residing in front of the users tympanic membrane or ear drum.

The signal processor may comprise a programmable microprocessor such as a programmable Digital Signal Processor executing a predetermined set of program instructions to amplify and process the microphone input signal in accordance with the predetermined or adaptive processing scheme. Signal processing functions or operations carried out by the signal processor may accordingly be implemented by dedicated hardware or may be implemented in one or more signal processors, or performed in a combination of dedicated hardware and one or more signal processors. As used herein, the terms "processor", "signal processor", "controller", "system", etc., are intended to refer to microprocessor or CPU-related entities, either hardware, a combination of hardware and software, software, or software in execution. For example, a "processor", "signal processor", "controller", "system", etc., may be, but is not limited to being, a process running on a processor, a processor, an object, an executable file, a thread of execution, and/or a program. By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry. Also, a processor (or similar terms) may be any component or any combination of components that is capable of performing signal processing. For examples, the signal processor may be an ASIC integrated processor, a FPGA processor, a general purpose processor, a microprocessor, a circuit component, or an integrated circuit.

The microphone input signal may be provided as a digital microphone input signal generated by an A/D-converter coupled to a transducer element of the microphone. The A/D-converter may be integrated with the signal processor for example on a common semiconductor substrate. Each of the processed output signal, the electronic ear canal signal, the compensated ear canal signal and the hybrid microphone signal may be provided in digital format at suitable sampling frequencies and resolutions. The sampling frequency of each of these digital signals may lie between 16 kHz and 48 kHz. The skilled person will understand that the respective functions of the compensation filter, the compensation summer, and the mixer may be performed by predetermined sets of executable program instructions and/or by dedicated and appropriately configured digital hardware.

The wireless data communication link may comprise a bi-directional or unidirectional data link. The wireless data communication link may operate in the industrial scientific medical (ISM) radio frequency range or frequency band such as the 2.40-2.50 GHz band or the 902-928 MHz band. Various details of the wireless data communication interface and the associated wireless data communication link is discussed in further detail below with reference to the appended drawings. The wired data communication interface may comprise a USB, IIC or SPI compliant data communication bus for transmitting the hybrid microphone signal to a separate wireless data transmitter or communication device such as a smartphone, or tablet.

One embodiment of the head-wearable communication device further comprises a lowpass filtering function inserted between the compensation summer and the mixer and configured to lowpass filter the compensated electronic ear canal signal before application to a first input of the mixer. In addition, or alternatively, the head-wearable communication device may comprise a highpass filtering function inserted between the microphone input signal and the mixer configured to highpass filter the microphone input signal before application to a second input of the mixer. The skilled person will understand that the each of lowpass filtering function and the highpass filter function may be implemented in numerous ways. In certain embodiments, the lowpass and highpass filtering functions comprise separate FIR or IIR filters with predetermined frequency responses or adjustable/adaptable frequency responses. An alternative embodiment of the lowpass and/or highpass filtering functions comprises a filter bank such as a digital filter bank. The filter bank may comprise a plurality of adjacent bandpass filters arranged across at least a portion of the audio frequency range. The filter bank may for example comprise between 4 and 25 bandpass filters for example adjacently arranged between at least 100 Hz and 5 kHz. The filter bank may comprise a digital filter bank such as an FFT based digital filter bank or a warped-frequency scale type of filter bank. The signal processor may be configured to generate or provide the lowpass filtering function and/or the highpass filter function as predetermined set(s) of executable program instructions running on the programmable microprocessor embodiment of the signal processor. Using the digital filter bank, the lowpass filtering function may be carried out by selecting respective outputs of a first subset of the plurality of adjacent bandpass filters for application to the first input of the mixer; and/or the highpass filtering function may comprise selecting respective outputs of a second subset of the plurality of adjacent bandpass filters for application to the second input of the mixer. The first and second subsets of adjacent bandpass filters of the filter bank may be substantially non-overlapping except at the respective cut-off frequencies discussed below.

The lowpass filtering function may have a cut-off frequency between 500 Hz and 2 kHz; and/or the highpass filtering function may have a cut-off frequency between 500 Hz and 2 kHz. In one embodiment, the cut-off frequency of the lowpass filtering function is substantially identical to the cut-off frequency of the highpass filtering function. According to another embodiment, a summed magnitude of the respective output signals of the lowpass filtering function and highpass filtering function is substantially unity at least between 100 Hz and 5 kHz. The two latter embodiments of the lowpass and highpass filtering functions typically will lead to a relatively flat magnitude of the summed output of the filtering functions as discussed in further detail below with reference to the appended drawings.

The compensation filter may be configured to model a transfer function between the loudspeaker and the ear canal microphone. The transfer function between the loudspeaker and the ear canal microphone typically comprises an acoustic transfer function between the loudspeaker and the ear canal microphone under normal operational conditions of the head-wearable communication device, i.e. with the latter arranged at or the user's ear. The transfer function between the loudspeaker and the ear canal microphone may additionally comprise frequency response characteristics of the loudspeaker and/or the ear canal microphone. The compensation filter may comprise an adaptive filter, such as an adaptive FIR filter or an adaptive IIR filter, or a static FIR or IIR filter configured with a suitable frequency response, as discussed in additional detail below with reference to the appended drawings.

According to yet another embodiment of the head-worn listening device, the signal processor is configured to:

estimate a signal feature of the microphone input signal, controlling relative contributions of the compensated ear canal signal and the microphone input signal to the hybrid microphone signal based on the determined signal feature of the microphone input signal. According to the latter embodiment, the signal processor may control the relative contributions of the compensated ear canal signal and the microphone input signal to the hybrid microphone signal by adjusting the respective cut-off frequencies of the lowpass and highpass filtering functions discussed above in accordance with the determined signal feature. The signal feature of the microphone input signal may comprise a signal-to-noise ratio of the microphone input signal—for example measured/estimated over a particular audio bandwidth of interest such as 100 Hz to 5 kHz. The signal feature of the microphone input signal may comprise a noise level, e.g. expressed in dB SPL, of the microphone input signal. The signal processor may in addition, or alternatively, be configured to control the relative amplifications or attenuations of the compensated ear canal signal and the microphone input signal before application to the mixer based on the determined signal feature of the microphone input signal. One or both of these methodologies for controlling the relative contributions of the compensated ear canal signal and the microphone input signal to the hybrid microphone signal may be exploited to make the contribution from the compensated ear canal signal relatively small in sound environments with a high signal-to-noise ratio, e.g. above 10 dB, of the microphone input signal and relatively large in sound environments with a low signal-to-noise ratio, e.g. below 0 dB, of the microphone input signal as discussed in further detail below with reference to the appended drawings.

A second aspect relates to a multi-user call centre communication system comprising a plurality of head-wearable communication devices, for example embodied as wireless headsets, according to any of the above described embodiments thereof, wherein the plurality of head-wearable communication devices are mounted on, or at, respective ears of a plurality of call centre service individuals. The noise-suppression properties of the present head-wearable communication devices make these advantageous for application in numerous types of multi-user environments where a substantial level of environmental noise of is present due numerous interfering noise sources. The noise suppression properties of the present head-wearable communication devices may provide hybrid microphone signals, representing the user's own voice, with improved comfort and intelligibility for benefit of the far-end recipient.

A third aspect relates to a method of generating and transmitting a hybrid microphone signal to a far end recipient by a head-wearable hearing device. The method comprising:

receiving and converting environmental sound into a microphone input signal, receiving and processing the microphone input signal in accordance with a predetermined or adaptive processing scheme for generating an processed output signal, converting the processed output signal into a corresponding acoustic output signal by a loudspeaker or receiver to produce ear canal sound pressure in a user's ear canal, filtering the processed output signal by a compensation filter to produce a filtered processed output signal, sensing the ear canal sound pressure by an ear canal microphone and converting the ear canal sound pressure into an electronic ear canal signal, subtracting the filtered processed output signal and the electronic ear canal signal to produce a compensated ear canal signal, combining the compensated ear canal signal and the microphone input signal to produce the hybrid microphone signal; and transmitting the hybrid microphone signal to a far end recipient through a wireless or wired data communication link The methodology may further comprise:

estimating a signal feature of the microphone input signal or a signal derived from the microphone input signal, controlling relative contributions of the compensated ear canal signal and the microphone input signal to the hybrid microphone signal based on the determined signal feature of the microphone input signal or the signal derived therefrom.

One embodiment of the methodology further comprises:

lowpass filtering the compensated ear canal signal before combining with the microphone input signal and/or highpass filtering the microphone input signal before combining with the compensated ear canal signal. The skilled person will understand the lowpass filtering and/or the highpass filtering may comprise the application of any of the above-discussed embodiments of the filter bank to the microphone input signal and the compensated ear canal signal.

The present disclosure relates to different aspects including the system described above and in the following, and corresponding system parts, methods, devices, systems, networks, kits, uses and/or product means, each yielding one or more of the benefits and advantages described in connection with the first mentioned aspect, and each having one or more embodiments corresponding to the embodiments described in connection with the first mentioned aspect and/or disclosed in the appended claims.

A hearing device includes: a first input transducer configured to convert an acoustic signal into a first input signal; a processing unit configured to provide a processed signal based on the first input signal; an acoustic output transducer configured to provide an audio output signal of based on the processed signal; a second input transducer configured to provide a second input signal based at least on the audio output signal from the acoustic output transducer and a body-conducted voice signal from a user of the hearing device; and a user voice extraction unit connected to the processing unit for receiving the processed signal, and connected to the second input transducer for receiving the second input signal, wherein the user voice extraction unit is configured to extract a voice signal based at least on the second input signal and the processed signal.

Optionally, the second input transducer is configured to pick-up the body-conducted voice signal emanated from a mouth and/or a throat of the user, and transmitted through bony structures, cartilage, soft-tissue, tissue and/or a skin of the user.

Optionally, the second input transducer is configured to be arranged in an ear canal of the user of the hearing device.

Optionally, the second input transducer comprises a vibration sensor, a bone-conduction sensor, a motion sensor, an acoustic sensor, or any combination of the foregoing.

Optionally, the first input transducer is configured to be arranged outside an ear canal of the user of the hearing device, and wherein the first input transducer is configured to detect sounds from a surrounding of the user.

Optionally, the hearing device is configured to receive a transmitted signal transmitted from at least one external device, and wherein the processed signal includes the transmitted signal.

Optionally, the user voice extraction unit is configured to process the transmitted signal when extracting the voice signal.

Optionally, the user voice extraction unit comprises a filter configured to cancel or reduce an effect corresponding to the audio output signal from the second input signal.

Optionally, the hearing device further includes a voice processing unit for processing the extracted voice signal before the hearing device transmit the extracted voice signal to at least one external device.

Optionally, the voice processing unit is configured to process the extracted voice signal based on the first input signal.

Optionally, the hearing device further includes a voice processing unit configured to minimize or reduce an effect corresponding with the first acoustic signal in the extracted voice signal.

Optionally, the hearing device further includes a voice processing unit having a spectral shaping unit for shaping a spectral content of the extracted voice signal to have a different spectral content than the body-conducted voice signal.

Optionally, the hearing device further includes a voice processing unit having a bandwidth extension unit configured for extending a bandwidth of the extracted voice signal.

Optionally, the hearing device further includes a voice processing unit having a voice activity detector configured for turning on/off a function of the voice processing unit, and wherein the extracted voice signal is an input to the voice activity detector.

Optionally, the second input transducer is configured to perform a conversion of the first acoustic signal.

A binaural hearing device system includes a first hearing device and a second hearing device, wherein the first hearing device is any of the embodiments of the hearing device described herein; wherein the first hearing device is configured to provide the extracted voice signal as a first extracted voice signal, and wherein the second hearing device is configured to provide a second extracted voice signal; and wherein the binaural hearing device is configured to transmit the first extracted voice signal and/or the second extracted voice signal to at least one external device.

A method performed by a hearing device, the hearing device comprises a processing unit, a first input transducer, a second input transducer, an acoustic output transducer, and a user voice extraction unit, includes: converting a first acoustic signal by the first input transducer into a first input signal; providing a processed signal by the processing unit based on the first input signal; providing an audio output signal by the acoustic output transducer based on the processed signal; providing a second input signal by the second input transducer based at least on the audio output signal from the acoustic output transducer and a body-conducted voice signal from a user of the hearing device; and extracting a voice signal, by the user voice extraction unit, based at least on the second input signal and the processed signal.

Optionally, the method further includes transmitting the extracted voice signal to at least one external device.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
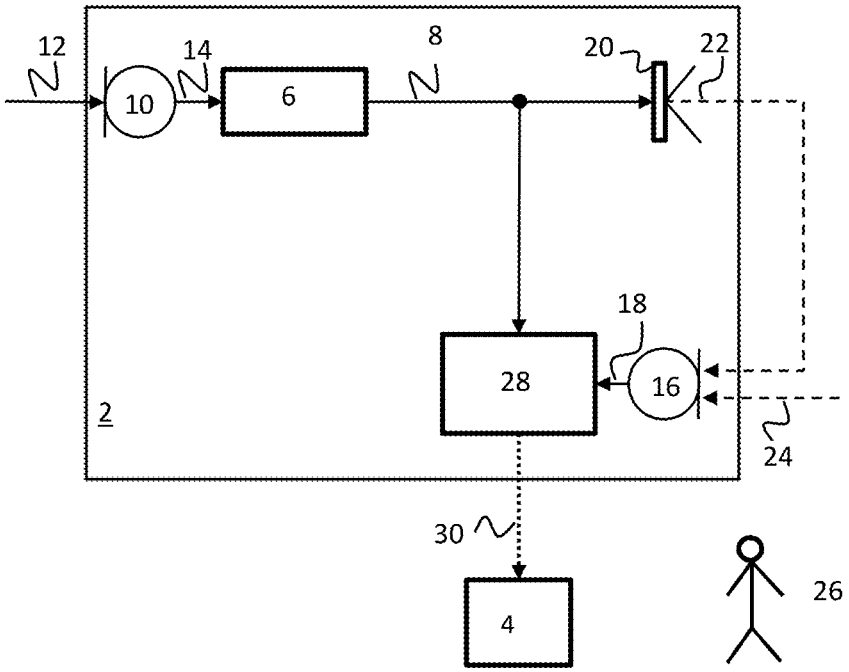
FIG. 1 schematically illustrates an example of a hearing device for audio communication with at least one external device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

FIG. 1 schematically illustrates an example of a hearing device 2 for audio communication with at least one external device 4. The hearing device 2 comprises a processing unit 6 for providing a processed first signal 8. The hearing device 2 comprises a first acoustic input transducer 10 connected to the processing unit 6 for converting a first acoustic signal 12 into a first input signal 14 to the processing unit 6 for providing the processed first signal 8. The hearing device 2 comprises a second input transducer 16 for providing a second input signal 18. The hearing device 2 comprises an acoustic output transducer 20 connected to the processing unit 6 for converting the processed first signal 8 into an audio output signal 22 for the acoustic output transducer 20. The second input signal 18 is provided by converting, in the second input transducer 16, at least the audio output signal 22 from the acoustic output transducer 20 and a body-conducted voice signal 24 from a user 26 of the hearing device 2. The hearing device 2 comprises a user voice extraction unit 28 for extracting a voice signal 30, where the user voice extraction unit 28 is connected to the processing unit 6 for receiving the processed first signal 8 and connected to the second input transducer 16 for receiving the second input signal 18. The user voice extraction unit 28 is configured to extract the voice signal 30 based on the second input signal 18 and the processed first signal 8. The voice signal 30 is configured to be transmitted to the at least one external device 4.

Figure 2:
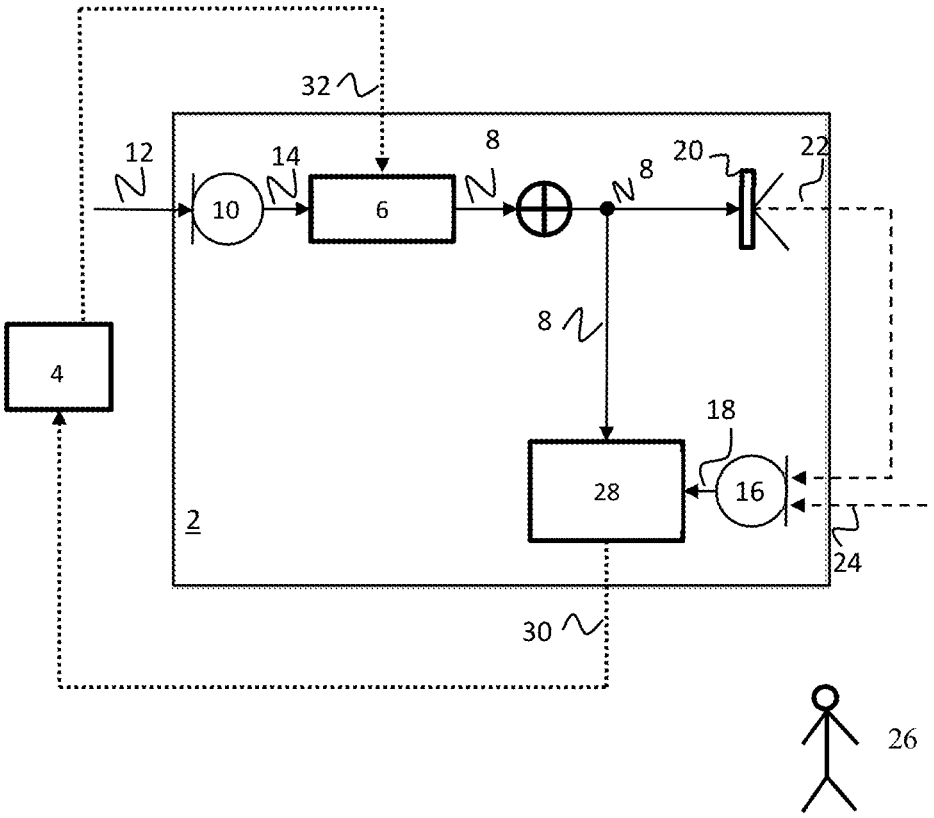
FIG. 2 schematically illustrates an example of a hearing device for audio communication with at least one external device.

FIG. 2 schematically illustrates an example of a hearing device 2 for audio communication with at least one external device 4. The hearing device 2 comprises a processing unit 6 for providing a processed first signal 8. The hearing device 2 comprises a first acoustic input transducer 10 connected to the processing unit 6 for converting a first acoustic signal 12 into a first input signal 14 to the processing unit 6 for providing the processed first signal 8. The hearing device 2 comprises a second input transducer 16 for providing a second input signal 18. The hearing device 2 comprises an acoustic output transducer 20 connected to the processing unit 6 for converting the processed first signal 8 into an audio output signal 22 for the acoustic output transducer 20. The second input signal 18 is provided by converting, in the second input transducer 16, at least the audio output signal 22 from the acoustic output transducer 20 and a body-conducted voice signal 24 from a user 26 of the hearing device 2. The hearing device 2 comprises a user voice extraction unit 28 for extracting a voice signal 30, where the user voice extraction unit 28 is connected to the processing unit 6 for receiving the processed first signal 8 and connected to the second input transducer 16 for receiving the second input signal 18. The user voice extraction unit 28 is configured to extract the voice signal 30 based on the second input signal 18 and the processed first signal 8. The voice signal 30 is configured to be transmitted to the at least one external device 4.

A first transmitted signal 32 is provided to the hearing device 2 from the at least one external device 4 and/or from another external device. The first transmitted signal 32 may be included in the first processed signal 8 and in the second input signal 18 provided to the user voice extraction unit 28 for extracting the voice signal 30. The first transmitted signal 32 may be a streamed signal. The first transmitted signal 32 may be from the at least one external device 4 and/or from another external device.

Figure 3:
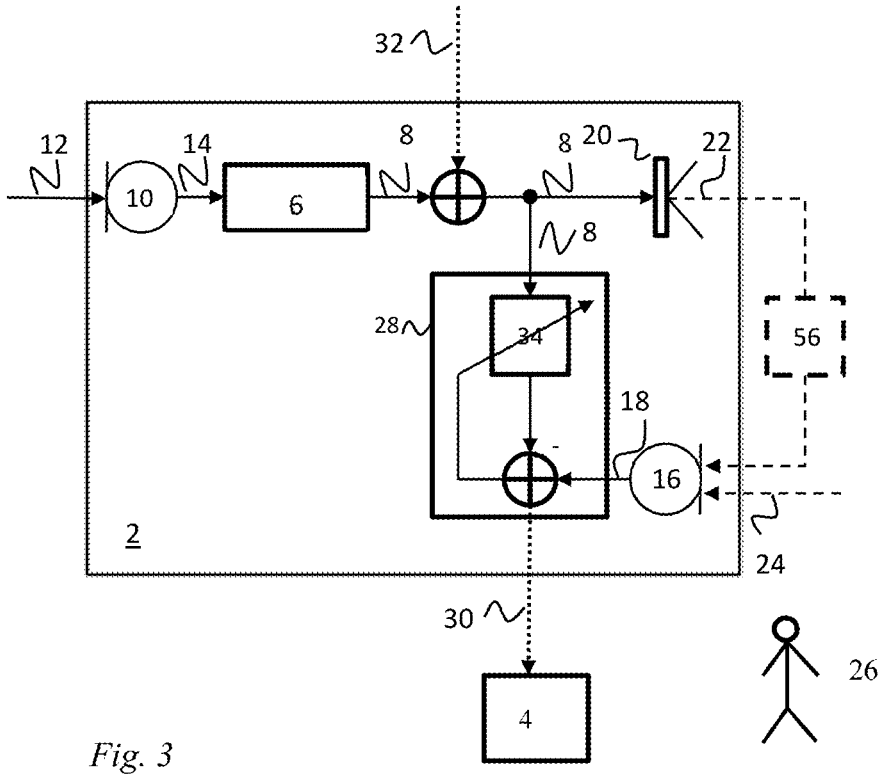
FIG. 3 schematically illustrates an example of a hearing device for audio communication with at least one external device.

The first transmitted signal 32 may be provided to the hearing device 2, for example added before the processing unit, at the processing unit as shown in FIG. 2 and/or after the processing unit as shown in FIG. 3. In an example the first transmitted signal 32 is added after the processing unit 6 and before the acoustic output transducer 20 and user voice extraction unit 28 as shown in FIG. 3.

FIG. 3 schematically illustrates an example of a hearing device 2 for audio communication with at least one external device 4. The hearing device 2 comprises a processing unit 6 for providing a processed first signal 8. The hearing device 2 comprises a first acoustic input transducer 10 connected to the processing unit 6 for converting a first acoustic signal 12 into a first input signal 14 to the processing unit 6 for providing the processed first signal 8. The hearing device 2 comprises a second input transducer 16 for providing a second input signal 18. The hearing device 2 comprises an acoustic output transducer 20 connected to the processing unit 6 for converting the processed first signal 8 into an audio output signal 22 for the acoustic output transducer 20. The second input signal 18 is provided by converting, in the second input transducer 16, at least the audio output signal 22 from the acoustic output transducer 20 and a body-conducted voice signal 24 from a user 26 of the hearing device 2. The hearing device 2 comprises a user voice extraction unit 28 for extracting a voice signal 30, where the user voice extraction unit 28 is connected to the processing unit 6 for receiving the processed first signal 8 and connected to the second input transducer 16 for receiving the second input signal 18. The user voice extraction unit 28 is configured to extract the voice signal 30 based on the second input signal 18 and the processed first signal 8. The voice signal 30 is configured to be transmitted to the at least one external device 4.

The audio output signal 22 may be considered to be transmitted through the ear canal before being provided to the second input transducer 16 thereby providing an ear canal response 56.

A first transmitted signal 32 is provided to the hearing device 2 from the at least one external device 4 and/or from another external device. The first transmitted signal 32 may be included in the first processed signal 8 and in the second input signal 18 provided to the user voice extraction unit 28 for extracting the voice signal 30. The first transmitted signal 32 may be a streamed signal.

The first transmitted signal 32 may be provided to the hearing device 2, for example added before the processing unit, at the processing unit as shown in FIG. 2 and/or after the processing unit as shown in FIG. 3. In an example the first transmitted signal 32 is added after the processing unit 6 and before the acoustic output transducer 20 and user voice extraction unit 28 as shown in FIG. 3.

Figure 4:
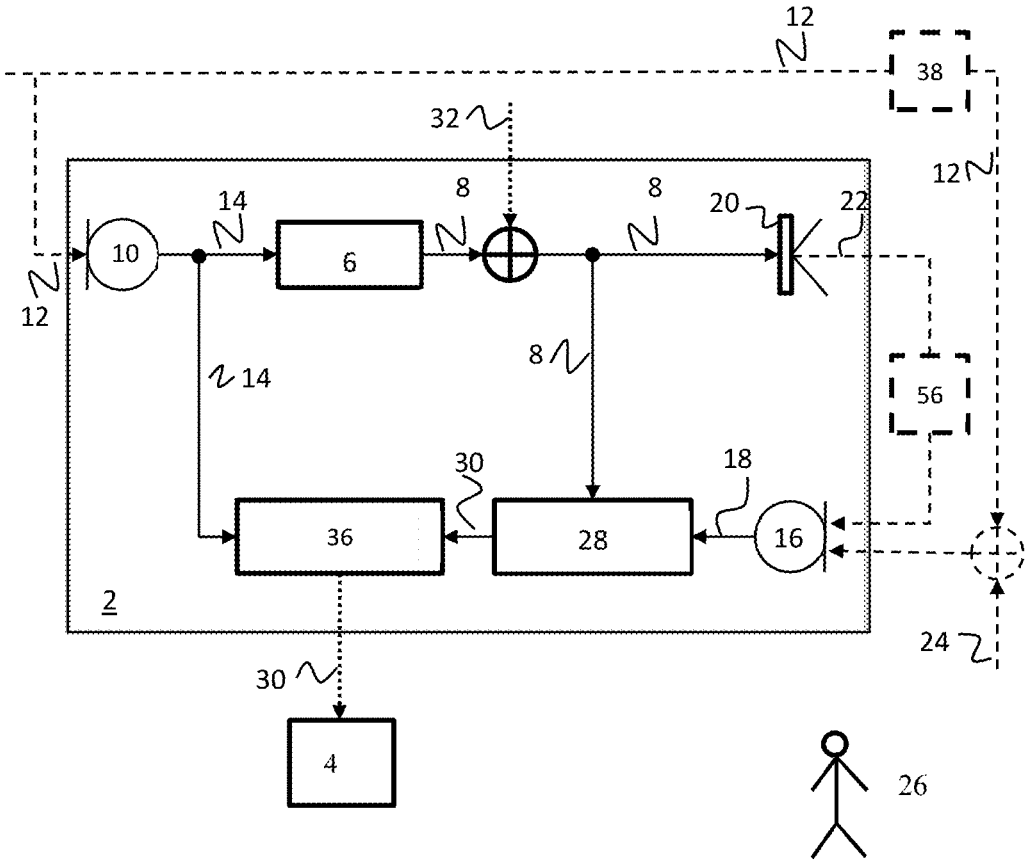
FIG. 4 schematically illustrates an example of a hearing device for audio communication with at least one external device.

The user voice extraction unit 28 comprises a first filter 34 configured to cancel the audio output signal 22 from the second input signal 18. The second input signal 18 is provided by converting, in the second input transducer 16, at least the audio output signal 22 from the acoustic output transducer 20 and a body-conducted voice signal 24 from a user 26 of the hearing device 2. Thus the second input signal 18 comprises a part originating from the audio output signal 22 from the acoustic output transducer 20 and a part originating from the body-conducted voice signal 24 of the user. Thus when the audio output signal 22 is cancelled from the second input signal 18 in the first filter 34 of the user voice extraction unit 28, then the body-conducted voice signal 24 remains and can be extracted to the external device 4. The audio output signal 22 comprises the processed first signal 8 from the processing unit 6 and the first transmitted signal 32. In FIG. 4 it can be seen that a combination of the processed first signal 8 and the first transmitted signal 32 is provided to the first filter 34 as input to the voice extraction unit 28.

FIG. 4 schematically illustrates an example of a hearing device 2 for audio communication with at least one external device 4. The hearing device 2 comprises a processing unit 6 for providing a processed first signal 8. The hearing device 2 comprises a first acoustic input transducer 10 connected to the processing unit 6 for converting a first acoustic signal 12 into a first input signal 14 to the processing unit 6 for providing the processed first signal 8. The hearing device 2 comprises a second input transducer 16 for providing a second input signal 18. The hearing device 2 comprises an acoustic output transducer 20 connected to the processing unit 6 for converting the processed first signal 8 into an audio output signal 22 for the acoustic output transducer 20. The second input signal 18 is provided by converting, in the second input transducer 16, at least the audio output signal 22 from the acoustic output transducer 20 and a body-conducted voice signal 24 from a user 26 of the hearing device 2. The hearing device 2 comprises a user voice extraction unit 28 for extracting a voice signal 30, where the user voice extraction unit 28 is connected to the processing unit 6 for receiving the processed first signal 8 and connected to the second input transducer 16 for receiving the second input signal 18. The user voice extraction unit 28 is configured to extract the voice signal 30 based on the second input signal 18 and the processed first signal 8. The voice signal 30 is configured to be transmitted to the at least one external device 4.

The audio output signal 22 may be considered to be transmitted through the ear canal before being provided to the second input transducer 16 thereby providing an ear canal response 56.

A first transmitted signal 32 is provided to the hearing device 2 from the at least one external device 4 and/or from another external device. The first transmitted signal 32 may be included in the first processed signal 8 and in the second input signal 18 provided to the user voice extraction unit 28 for extracting the voice signal 30. The first transmitted signal 32 may be a streamed signal.

The first transmitted signal 32 may be provided to the hearing device 2, for example added before the processing unit, at the processing unit as shown in FIG. 2 and/or after the processing unit as shown in FIG. 3 and FIG. 4. In an example the first transmitted signal 32 is added after the processing unit 6 and before the acoustic output transducer 20 and user voice extraction unit 28 as shown in FIG. 3 and FIG. 4.

The extracted voice signal 30 is provided by further converting, in the second input transducer 16, the first acoustic signal 12. Thus besides receiving the first acoustic signal 12 in the first acoustic input transducer 10, the first acoustic signal 12 is also received in the second input transducer 16. Accordingly the first acoustic signal 12 may form part of the second input signal 16, and thus the first acoustic signal 12 may form part of the extracted voice signal 30. In FIG. 4 the first acoustic signal 12 is shown as added together with the body-conducted voice signal 24 before provided to the second input transducer 16. However it is understood that the first acoustic signal 12 may be provided directly to the second input transducer 16 without being combined with the body-conducted voice signal 24 before. The first acoustic signal 12 may also be transmitted through the surroundings 38 before being provided to the second input transducer 16.

The hearing device 2 comprises a voice processing unit 36 for processing the extracted voice signal 30 based on the extracted voice signal 30 and/or the first input signal 14 before transmitting the extracted voice signal 30 to the at least one external device 4. Thus before transmitting the extracted voice signal 30, this extracted voice signal 30 is processed based on itself, as received from the voice extraction unit 28, and based on the first input signal 14 from the first acoustic input transducer 10. The first input signal 14 from the first acoustic input transducer 10 may be used in the voice processing unit 36 for filtering out sounds/noise from the surroundings, which may be received by the first acoustic input transducer 10, which may be an outer reference microphone in the hearing device 2.

Figure 5:
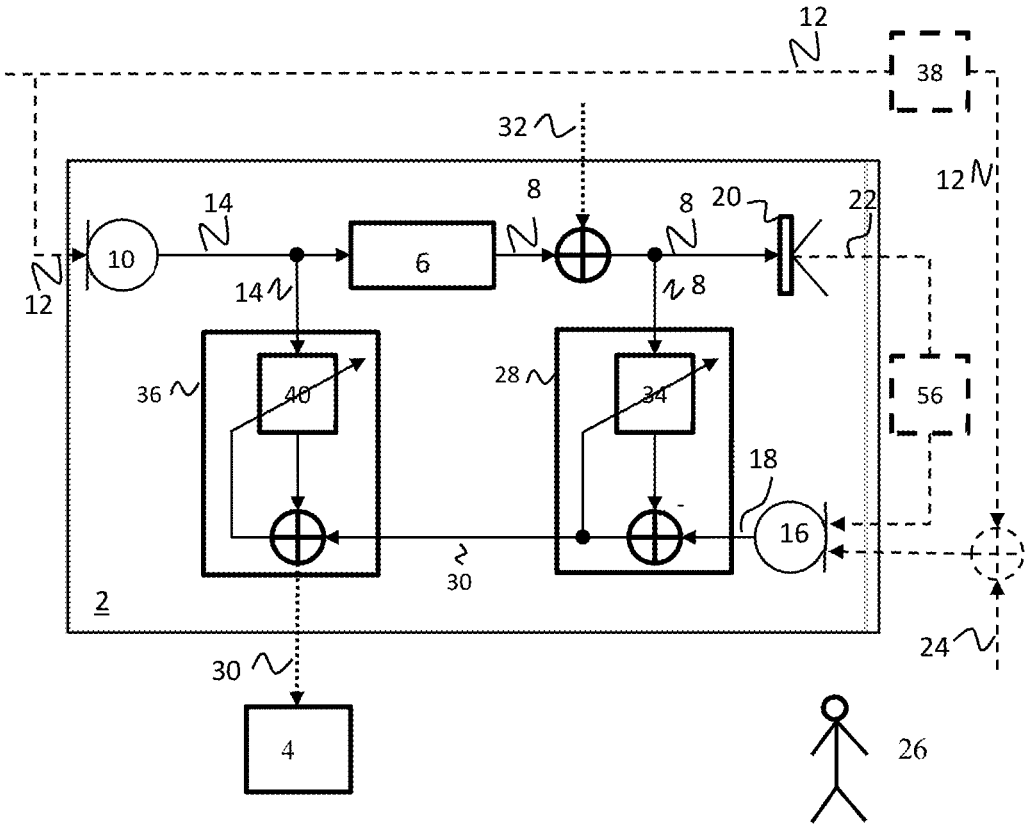
FIG. 5 schematically illustrates an example of a hearing device for audio communication with at least one external device.

FIG. 5 schematically illustrates an example of a hearing device 2 for audio communication with at least one external device 4. The hearing device 2 comprises a processing unit 6 for providing a processed first signal 8. The hearing device 2 comprises a first acoustic input transducer 10 connected to the processing unit 6 for converting a first acoustic signal 12 into a first input signal 14 to the processing unit 6 for providing the processed first signal 8. The hearing device 2 comprises a second input transducer 16 for providing a second input signal 18. The hearing device 2 comprises an acoustic output transducer 20 connected to the processing unit 6 for converting the processed first signal 8 into an audio output signal 22 for the acoustic output transducer 20. The second input signal 18 is provided by converting, in the second input transducer 16, at least the audio output signal 22 from the acoustic output transducer 20 and a body-conducted voice signal 24 from a user 26 of the hearing device 2. The hearing device 2 comprises a user voice extraction unit 28 for extracting a voice signal 30, where the user voice extraction unit 28 is connected to the processing unit 6 for receiving the processed first signal 8 and connected to the second input transducer 16 for receiving the second input signal 18. The user voice extraction unit 28 is configured to extract the voice signal 30 based on the second input signal 18 and the processed first signal 8. The voice signal 30 is configured to be transmitted to the at least one external device 4.

The audio output signal 22 may be considered to be transmitted through the ear canal before being provided to the second input transducer 16 thereby providing an ear canal response 56.

A first transmitted signal 32 is provided to the hearing device 2 from the at least one external device 4 and/or from another external device. The first transmitted signal 32 may be included in the first processed signal 8 and in the second input signal 18 provided to the user voice extraction unit 28 for extracting the voice signal 30. The first transmitted signal 32 may be a streamed signal.

The first transmitted signal 32 may be provided to the hearing device 2, for example added before the processing unit, at the processing unit as shown in FIG. 2 and/or after the processing unit as shown in FIG. 3 and FIG. 4 and FIG. 5. In an example the first transmitted signal 32 is added after the processing unit 6 and before the acoustic output transducer 20 and user voice extraction unit 28 as shown in FIG. 3 and FIG. 4 and FIG. 5.

The extracted voice signal 30 is provided by further converting, in the second input transducer 16, the first acoustic signal 12. Thus besides receiving the first acoustic signal 12 in the first acoustic input transducer 10, the first acoustic signal 12 is also received in the second input transducer 16. Accordingly the first acoustic signal 12 may form part of the second input signal 16, and thus the first acoustic signal 12 may form part of the extracted voice signal 30. In FIG. 5 the first acoustic signal 12 is shown as added together with the body-conducted voice signal 24 before provided to the second input transducer 16. However it is understood that the first acoustic signal 12 may be provided directly to the second input transducer 16 without being combined with the body-conducted voice signal 24 before. The first acoustic signal 12 may also be transmitted through the surroundings 38 before being provided to the second input transducer 16.

The user voice extraction unit 28 comprises a first filter 34 configured to cancel the audio output signal 22 from the second input signal 18. The second input signal 18 is provided by converting, in the second input transducer 16, at least the audio output signal 22 from the acoustic output transducer 20, the first acoustic signal 12, and a body-conducted voice signal 24 from a user 26 of the hearing device 2. Thus the second input signal 18 comprises a part originating from the audio output signal 22 from the acoustic output transducer 20, a part originating from the first acoustic signal 12 and a part originating from the body-conducted voice signal 24 of the user. Thus when the audio output signal 22 is cancelled from the second input signal 18 in the first filter 34 of the user voice extraction unit 28, then the body-conducted voice signal 24 and the first acoustic signal 12 remains in the second input signal 18 which is provided to the user voice extraction unit 28. The audio output signal 22 comprises the processed first signal 8 from the processing unit 6 and the first transmitted signal 32. In FIG. 5 it can be seen that a combination of the processed first signal 8 and the first transmitted signal 32 is provided to the first filter 34 as input to the voice extraction unit 28.

The hearing device 2 comprises a voice processing unit 36 for processing the extracted voice signal 30 based on the extracted voice signal 30 and/or the first input signal 14 before transmitting the extracted voice signal 30 to the at least one external device 4. Thus before transmitting the extracted voice signal 30, this extracted voice signal 30 is processed based on itself, as received from the voice extraction unit 28, and based on the first input signal 14 from the first acoustic input transducer 10. The first input signal 14 from the first acoustic input transducer 10 may be used in the voice processing unit 36 for filtering out sounds/noise from the surroundings, which may be received by the first acoustic input transducer 10, which may be an outer reference microphone in the hearing device 2. The extracted voice signal 30 at least comprises a part being the body-conducted voice signal 24 from the user 26 and a part being the first acoustic signal 12. Thus in the voice processing unit 36 the first acoustic signal 12 may be filtered out, corresponding to filtering out the surrounding sounds and noise from the environment of the user 26 of the hearing device 26.

The voice processing unit 36 comprises at least a second filter 40 configured to minimize any portion of the first acoustic signal 12 present in the extracted voice signal 30. The first acoustic signal 12 may be the sounds or noise from the surroundings of the user 26 received by the first acoustic input transducer 10, which may be an outer reference microphone. When the portion of the first acoustic signal 12 in the extracted voice signal 30 is minimized, the sounds or noise from the surroundings of the user 26 received by the first acoustic input transducer 10, which may be an outer reference microphone, is minimized, whereby this sound or noise from the surroundings may not be transmitted to the external device 4. This is an advantage as the user of the external device then receives primarily the voice signal from the user of the hearing device 2, and does not receive the surrounding sounds or noise from the environment of the user 26 of the hearing device 2.

Figure 6A:
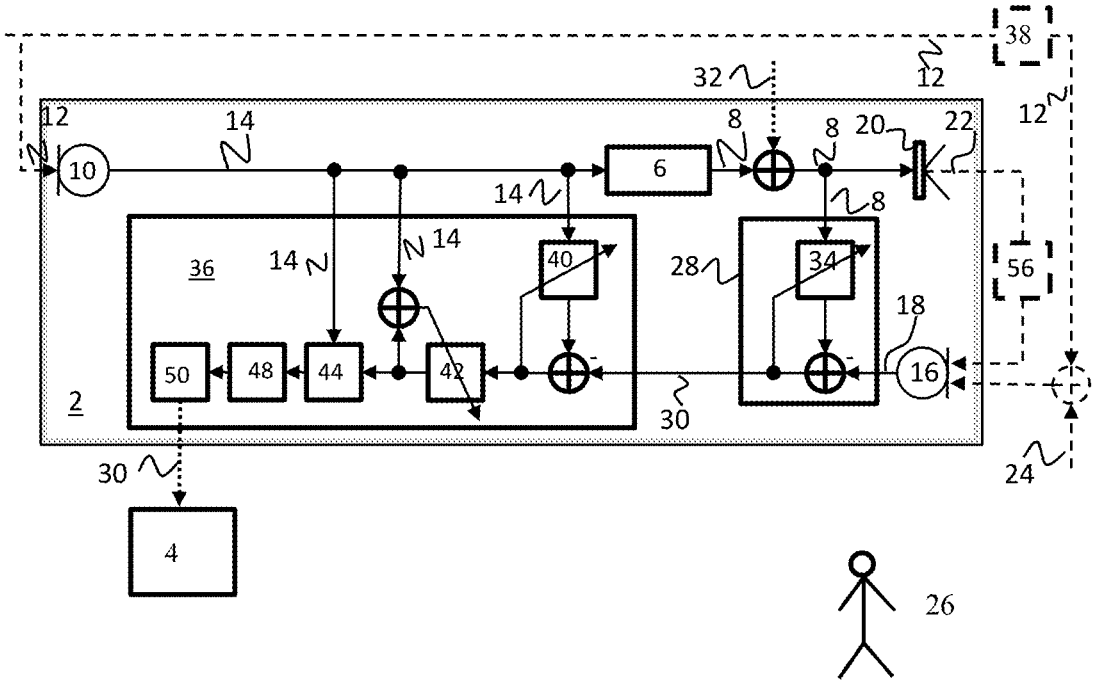
FIG. 6*a*-6*b*) schematically illustrate an example of a hearing device for audio communication with at least one external device.

FIGS. 6*a*) and 6*b*) schematically illustrate an example of a hearing device 2 for audio communication with at least one external device 4. The hearing device 2 comprises a processing unit 6 for providing a processed first signal 8. The hearing device 2 comprises a first acoustic input transducer 10 connected to the processing unit 6 for converting a first acoustic signal 12 into a first input signal 14 to the processing unit 6 for providing the processed first signal 8. The hearing device 2 comprises a second input transducer 16 for providing a second input signal 18. The hearing device 2 comprises an acoustic output transducer 20 connected to the processing unit 6 for converting the processed first signal 8 into an audio output signal 22 for the acoustic output transducer 20. The second input signal 18 is provided by converting, in the second input transducer 16, at least the audio output signal 22 from the acoustic output transducer 20 and a body-conducted voice signal 24 from a user 26 of the hearing device 2. The hearing device 2 comprises a user voice extraction unit 28 for extracting a voice signal 30, where the user voice extraction unit 28 is connected to the processing unit 6 for receiving the processed first signal 8 and connected to the second input transducer 16 for receiving the second input signal 18. The user voice extraction unit 28 is configured to extract the voice signal 30 based on the second input signal 18 and the processed first signal 8. The voice signal 30 is configured to be transmitted to the at least one external device 4.

The audio output signal 22 may be considered to be transmitted through the ear canal before being provided to the second input transducer 16 thereby providing an ear canal response 56.

A first transmitted signal 32 is provided to the hearing device 2 from the at least one external device 4 and/or from another external device. The first transmitted signal 32 may be included in the first processed signal 8 and in the second input signal 18 provided to the user voice extraction unit 28 for extracting the voice signal 30. The first transmitted signal 32 may be a streamed signal.

The first transmitted signal 32 may be provided to the hearing device 2, for example added before the processing unit, at the processing unit as shown in FIG. 2 and/or after the processing unit as shown in FIG. 3 and FIG. 4 and FIG. 5. In an example the first transmitted signal 32 is added after the processing unit 6 and before the acoustic output transducer 20 and user voice extraction unit 28 as shown in FIG. 3 and FIG. 4 and FIG. 5.

The extracted voice signal 30 is provided by further converting, in the second input transducer 16, the first acoustic signal 12. Thus besides receiving the first acoustic signal 12 in the first acoustic input transducer 10, the first acoustic signal 12 is also received in the second input transducer 16. Accordingly the first acoustic signal 12 may form part of the second input signal 16, and thus the first acoustic signal 12 may form part of the extracted voice signal 30. In FIG. 5 the first acoustic signal 12 is shown as added together with the body-conducted voice signal 24 before provided to the second input transducer 16. However it is understood that the first acoustic signal 12 may be provided directly to the second input transducer 16 without being combined with the body-conducted voice signal 24 before. The first acoustic signal 12 may also be transmitted through the surroundings 38 before being provided to the second input transducer 16.

The user voice extraction unit 28 comprises a first filter 34 configured to cancel the audio output signal 22 from the second input signal 18. The second input signal 18 is provided by converting, in the second input transducer 16, at least the audio output signal 22 from the acoustic output transducer 20, the first acoustic signal 12, and a body-conducted voice signal 24 from a user 26 of the hearing device 2. Thus the second input signal 18 comprises a part originating from the audio output signal 22 from the acoustic output transducer 20, a part originating from the first acoustic signal 12 and a part originating from the body-conducted voice signal 24 of the user. Thus when the audio output signal 22 is cancelled from the second input signal 18 in the first filter 34 of the user voice extraction unit 28, then the body-conducted voice signal 24 and the first acoustic signal 12 remains in the second input signal 18 which is provided to the user voice extraction unit 28. The audio output signal 22 comprises the processed first signal 8 from the processing unit 6 and the first transmitted signal 32. In FIG. 5 it can be seen that a combination of the processed first signal 8 and the first transmitted signal 32 is provided to the first filter 34 as input to the voice extraction unit 28.

The hearing device 2 comprises a voice processing unit 36 for processing the extracted voice signal 30 based on the extracted voice signal 30 and/or the first input signal 14 before transmitting the extracted voice signal 30 to the at least one external device 4. Thus before transmitting the extracted voice signal 30, this extracted voice signal 30 is processed based on itself, as received from the voice extraction unit 28, and based on the first input signal 14 from the first acoustic input transducer 10. The first input signal 14 from the first acoustic input transducer 10 may be used in the voice processing unit 36 for filtering out sounds/noise from the surroundings, which may be received by the first acoustic input transducer 10, which may be an outer reference microphone in the hearing device 2. The extracted voice signal 30 at least comprises a part being the body-conducted voice signal 24 from the user 26 and a part being the first acoustic signal 12. Thus in the voice processing unit 36 the first acoustic signal 12 may be filtered out, corresponding to filtering out the surrounding sounds and noise from the environment of the user 26 of the hearing device 26.

The voice processing unit 36 comprises at least a second filter 40 configured to minimize any portion of the first acoustic signal 12 present in the extracted voice signal 30. The first acoustic signal 12 may be the sounds or noise from the surroundings of the user 26 received by the first acoustic input transducer 10, which may be an outer reference microphone. When the portion of the first acoustic signal 12 in the extracted voice signal 30 is minimized, the sounds or noise from the surroundings of the user 26 received by the first acoustic input transducer 10, which may be an outer reference microphone, is minimized, whereby this sound or noise from the surroundings may not be transmitted to the external device 4. This is an advantage as the user of the external device then receives primarily the voice signal from the user of the hearing device 2, and does not receive the surrounding sounds or noise from the environment of the user 26 of the hearing device 2.

The voice processing unit 36 may comprises a spectral shaping unit 42 for shaping the spectral content of the extracted voice signal 30 to have a different spectral content than the body-conducted voice signal 24. The first input signal 14 may be provided to the spectral shaping unit 44. The body-conducted voice signal 24 may be a spectrally modified version of the voice or speech signal that emanates from the mouth of the user 26, as the body-conducted voice signal 24 is conducted through the material of the body of the user. Thus in order to provide that the body-conducted voice signal 24 has a spectral content which resembles a voice signal emanating from the mouth of the user 26, i.e. conducted through air, the spectral content of the extracted voice signal may be shaped or changed accordingly. The spectral shaping unit 42 may be a filter, such as a third filter 42, which may be an adaptive filter or a non-adaptive filter. The spectral shaping unit 42 or third filter 42 may be running at a baseband sample rate, and/or at a higher rate. The first input signal 14 maybe provided to the spectral shaping unit 44.

The voice processing unit 36 may comprises a bandwidth extension unit 44 configured for extending the bandwidth of the extracted voice signal 30 before it is transmitted to the external device 4. The first input signal 14 maybe provided to the bandwidth extension unit 44.

The voice processing unit 36 may comprise a noise filtering 48, such as a noise filtering 48 of very low frequencies and/or of very high frequencies.

The voice processing unit 36 may comprise an Automatic Gain Control (AGC) 50.

Figure 6B:
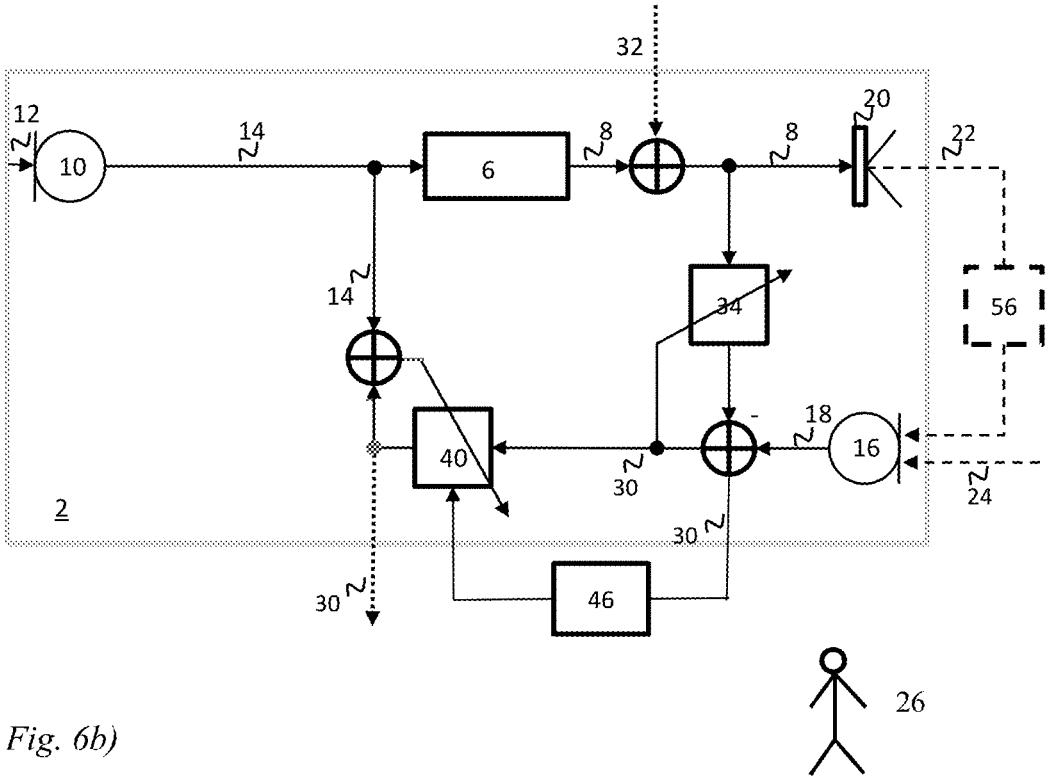

FIG. 6*b*) schematically illustrates that the hearing device 2 may comprise a voice activity detector 46. The voice activity detector 46 may be part of the voice processing unit 36 in FIG. 6*a*). The voice activity detector 46 may be configured for turning on/off the voice processing unit 36. The extracted voice signal 30 is provided as input to the voice activity detector 46. The voice activity detector 46 may provide enabling and/or disabling of any adaptation of filters, such as the first filter 34, the second filter 40 and/or the third filter 42, see FIG. 6*a*).

Figure 7:
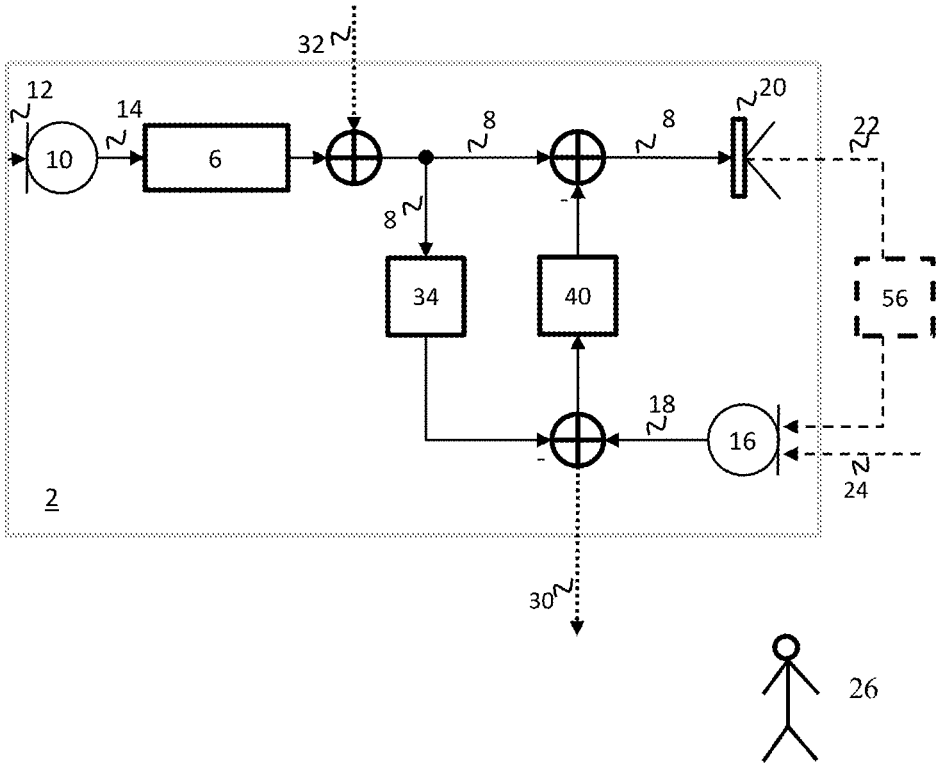
FIG. 7 schematically illustrates an example of a hearing device for audio communication with at least one external device.

FIG. 7 schematically illustrates an example of a hearing device 2 for audio communication with at least one external device 4 (not shown). The hearing device 2 comprises a processing unit 6 for providing a processed first signal 8. The hearing device 2 comprises a first acoustic input transducer 10 connected to the processing unit 6 for converting a first acoustic signal 12 into a first input signal 14 to the processing unit 6 for providing the processed first signal 8. The hearing device 2 comprises a second input transducer 16 for providing a second input signal 18. The hearing device 2 comprises an acoustic output transducer 20 connected to the processing unit 6 for converting the processed first signal 8 into an audio output signal 22 for the acoustic output transducer 20. The second input signal 18 is provided by converting, in the second input transducer 16, at least the audio output signal 22 from the acoustic output transducer 20 and a body-conducted voice signal 24 from a user 26 of the hearing device 2. The hearing device 2 comprises a user voice extraction unit 28 (not shown) for extracting a voice signal 30, where the user voice extraction unit 28 is connected to the processing unit 6 for receiving the processed first signal 8 and connected to the second input transducer 16 for receiving the second input signal 18. The user voice extraction unit 28 is configured to extract the voice signal 30 based on the second input signal 18 and the processed first signal 8. The voice signal 30 is configured to be transmitted to the at least one external device 4.

The audio output signal 22 may be considered to be transmitted through the ear canal before being provided to the second input transducer 16 thereby providing an ear canal response 56.

A first transmitted signal 32 is provided to the hearing device 2 from the at least one external device 4 and/or from another external device. The first transmitted signal 32 may be included in the first processed signal 8 and in the second input signal 18 provided to the user voice extraction unit 28 for extracting the voice signal 30. The first transmitted signal 32 may be a streamed signal.

The first transmitted signal 32 may be provided to the hearing device 2, for example added before the processing unit, at the processing unit as shown in FIG. 2 and/or after the processing unit. In an example the first transmitted signal 32 is added after the processing unit 6 and before the acoustic output transducer 20 and user voice extraction unit 28 as shown in FIG. 3 and FIG. 4 and FIG. 5.

The extracted voice signal 30 is provided by further converting, in the second input transducer 16, the first acoustic signal 12. Thus besides receiving the first acoustic signal 12 in the first acoustic input transducer 10, the first acoustic signal 12 is also received in the second input transducer 16. Accordingly the first acoustic signal 12 may form part of the second input signal 16, and thus the first acoustic signal 12 may form part of the extracted voice signal 30.

The user voice extraction unit 28 (not shown) comprises a first filter 34.

The voice processing unit 36 (not shown) comprises at least a second filter 40 configured to minimize any portion of the first acoustic signal 12 present in the extracted voice signal 30. The first acoustic signal 12 may be the sounds or noise from the surroundings of the user 26 received by the first acoustic input transducer 10, which may be an outer reference microphone. When the portion of the first acoustic signal 12 in the extracted voice signal 30 is minimized, the sounds or noise from the surroundings of the user 26 received by the first acoustic input transducer 10, which may be an outer reference microphone, is minimized, whereby this sound or noise from the surroundings may not be transmitted to the external device 4. This is an advantage as the user of the external device then receives primarily the voice signal from the user of the hearing device 2, and does not receive the surrounding sounds or noise from the environment of the user 26 of the hearing device 2.

The first filter 34 may be updated. The second filter 40 may be updated. The update of the second filter 40 may depend on multiple aspects, such as for example signals, models, constraints, etc.

The first filter 34 and/or the second filter 40 may be adaptive. For the second filter 40 to be adaptive, the first filter 34 may need to be adaptive as well. However, the first filter 34 may be adaptive without the second filter 40 being adaptive, The adaptation of the first filter 34 and/or of the second filter 40 can be done online and/or offline, thus the adaption may be an offline adaptation fitting or optimization.

Figure 8:
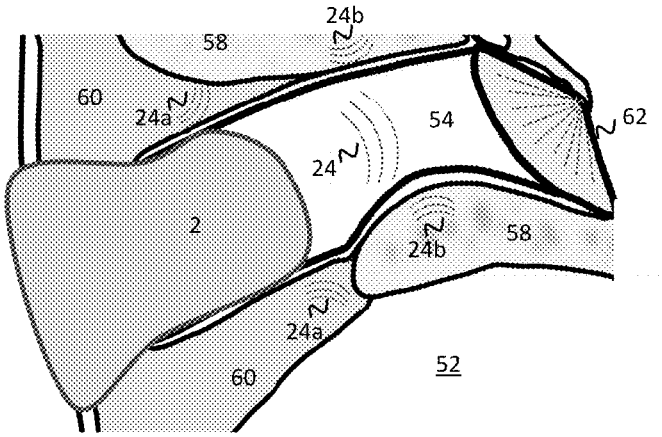
FIG. 8 schematically illustrates that the body-conducted voice signal emanates from the mouth and throat of the user and is transmitted through bony structures, cartilage, soft-tissue, tissue and/or skin of the user to the ear of the user and is configured to be picked-up by the second input transducer.

FIG. 8 schematically illustrates that the body-conducted voice signal 24, see FIGS. 1-7, emanates from the mouth and throat of the user and is transmitted through bony structures 58, cartilage, soft-tissue, tissue 60 and/or skin of the user to the ear 52 of the user and is configured to be picked-up by the second input transducer (not shown), see FIGS. 1-7. The body-conducted voice signal 24 may comprise a tissue conducted signal part 24*a* from the tissue parts 60 of the ear canal and a bone conducted signal part 24*b* from the bony parts 58 of the ear canal. The ear drum 62 is also illustrated. The body-conducted voice signal may be an acoustic signal. The body-conducted voice signal may be a vibration signal. The body-conducted voice signal may be a signal which is a combination of an acoustic signal and a vibration signal. The body-conducted voice signal may be conducted through both the body of the user and through air. The body-conducted voice signal is not a bone-conducted signal, such as a pure bone-conducted signal. The body-conducted signal is to be received in the ear canal 54 of the user of the hearing device 2 by the second input transducer. The body-conducted voice signal is transmitted through the body of the user from the mouth and throat of the user where the voice or speech is generated. The body-conducted voice signal is transmitted through the body of the user by the user's bones, bony-structures, cartilage, soft-tissue, tissue and/or skin. The body-conducted voice signal is transmitted at least partly through the material of the body, and the body-conducted voice signal may thus be at least partly a vibration signal. As there may also be air cavities in the body of the user, the body-conducted voice signal may also be an at least a partly air-transmitted signal, and the body-conducted voice signal may thus be at least partly be an acoustic signal.

The second input transducer is configured to be arranged in the ear canal 54 of the user of the hearing device 2. The second input transducer may be configured to be arranged completely in the ear canal 54.

The second input transducer may be a vibration sensor and/or a bone-conduction sensor and/or a motion sensor and/or an acoustic sensor. The second input transducer may be a combination of one or more sensors, such as a combination of one or more of a vibration sensor, a bone-conduction sensor, a motion sensor and an acoustic sensor. As an example the second input transducer may be a vibration sensor and an acoustic input transducer, such as a microphone, configured to be arranged in the ear canal 54 of the user.

Figure 9:
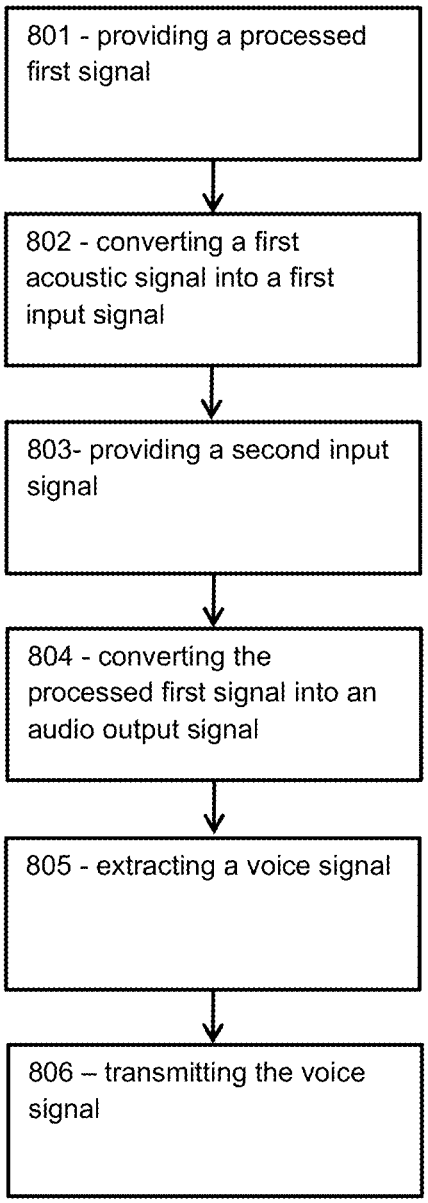
FIG. 9 schematically illustrates a flow chart of a method in a hearing device for audio communication between the hearing device and at least one external device.

FIG. 9 schematically illustrates a flow chart of a method in a hearing device. The method in the hearing device is for audio communication between the hearing device and at least one external device. The hearing device comprises a processing unit, a first acoustic input transducer, a second input transducer, an acoustic output transducer and a user voice extraction unit. The method comprises the following:

In a step 801 a processed first signal is provided in the processing unit.

In a step 802 a first acoustic signal is converted into a first input signal, in the first acoustic input transducer.

In a step 803 a second input signal is provided, in the second input transducer.

In a step 804 the processed first signal is converted into an audio output signal in the acoustic output transducer.

The second input signal is provided by converting, in the second input transducer, at least the audio output signal from the acoustic output transducer and a body-conducted voice signal from a user of the hearing device.

In a step 805 a voice signal is extracted, in the user voice extraction unit, based on the second input signal and the processed first signal.

In a step 806 the extracted voice signal is transmitted to the at least one external device.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device
4 external device
6 processing unit
8 processed first signal
10 first acoustic input transducer
12 first acoustic signal
14 first input signal
16 second input transducer
18 second input signal
20 acoustic output transducer
22 audio output signal
24 body-conducted voice signal
24*a* tissue conducted signal part of voice signal
24*b* bone conducted signal part of voice signal
26 user of the hearing device
28 user voice extraction unit
30 extracted voice signal
32 first transmitted signal
34 first filter
36 voice processing unit
38 transmission path of surroundings
40 second filter
42 spectral shaping unit
44 bandwidth extension unit
46 voice activity detector
48 noise filtering
50 Automatic Gain Control (AGC)
52 ear of user
54 ear canal
56 ear canal response
58 bony parts of ear canal 60 tissue parts of ear canal
62 ear drum
801*a* processed first signal is provided in the processing unit.
802*a* first acoustic signal is converted into a first input signal, in the first acoustic input transducer.
803 a second input signal is provided, in the second input transducer.
804 the processed first signal is converted into an audio output signal in the acoustic output transducer.
805 a voice signal is extracted, in the user voice extraction unit, based on the second input signal and the processed first signal.
806 the extracted voice signal is transmitted to the at least one external device.

The invention claimed is:

1. A hearing device comprising:

a first input transducer configured to convert an acoustic signal into a first input signal;

a processing unit configured to provide a processed signal based on the first input signal;

an acoustic output transducer configured to provide an audio output signal of based on the processed signal;

a second input transducer configured to provide a second input signal based at least on the audio output signal from the acoustic output transducer and a body-conducted voice signal from a user of the hearing device, wherein the second input transducer is configured to pick-up sound signal comprising the body-conducted voice signal emanated from a mouth and/or a throat of the user, and transmitted through bony structures, cartilage, soft-tissue, tissue and/or a skin of the user; and a user voice extraction unit connected to the processing unit for receiving the processed signal, and connected to the second input transducer for receiving the second input signal, wherein the user voice extraction unit is configured to extract a voice signal based at least on the second input signal and the processed signal;

wherein the hearing device is configured to communicate the extracted voice signal to at least one external device by transmitting the extracted voice signal away from the user.

2. The hearing device according to claim 1, wherein the second input transducer is configured to be arranged in an ear canal of the user of the hearing device.

3. The hearing device according to claim 1, wherein the second input transducer comprises a vibration sensor, a bone-conduction sensor, a motion sensor, an acoustic sensor, or any combination of the foregoing.

4. The hearing device according to claim 1, wherein the first input transducer is configured to be arranged outside an ear canal of the user of the hearing device, and wherein the first input transducer is configured to detect sounds from a surrounding of the user.

5. The hearing device according to claim 1, wherein the hearing device is configured to receive a transmitted signal transmitted from at least one external device, and wherein the processed signal includes the transmitted signal.

6. The hearing device according to claim 5, wherein the user voice extraction unit is configured to process the transmitted signal when extracting the voice signal.

7. The hearing device according to claim 1, wherein the user voice extraction unit comprises a filter configured to cancel or reduce an effect corresponding to the audio output signal from the second input signal.

8. The hearing device according to claim 1, further comprising a voice processing unit for processing the extracted voice signal before the hearing device transmit the extracted voice signal to the at least one external device.

9. The hearing device according to claim 8, wherein the voice processing unit is configured to process the extracted voice signal based on the first input signal.

10. The hearing device according to claim 1, further comprising a voice processing unit configured to minimize or reduce an effect corresponding with the first acoustic signal in the extracted voice signal.

11. The hearing device according to claim 1, further comprising a voice processing unit having a spectral shaping unit for shaping a spectral content of the extracted voice signal to have a different spectral content than the body-conducted voice signal.

12. The hearing device according to claim 1, further comprising a voice processing unit having a bandwidth extension unit configured for extending a bandwidth of the extracted voice signal.

13. The hearing device according to claim 1, further comprising a voice processing unit having a voice activity detector configured for turning on/off a function of the voice processing unit, and wherein the extracted voice signal is an input to the voice activity detector.

14. The hearing device according to claim 1, wherein the second input transducer is configured to perform a conversion of the first acoustic signal.

15. A binaural hearing device system comprising a first hearing device and a second hearing device, wherein the first hearing device is the hearing device according to claim 1;

wherein the first hearing device is configured to provide the extracted voice signal as a first extracted voice signal, and wherein the second hearing device is configured to provide a second extracted voice signal; and wherein the binaural hearing device is configured to transmit the first extracted voice signal and/or the second extracted voice signal to the at least one external device of the other user.

16. A method performed by a hearing device, the hearing device comprises a processing unit, a first input transducer, a second input transducer, an acoustic output transducer, and a user voice extraction unit, the method comprising:

converting a first acoustic signal by the first input transducer into a first input signal;

providing a processed signal by the processing unit based on the first input signal;

providing an audio output signal by the acoustic output transducer based on the processed signal;

providing a second input signal by the second input transducer based at least on the audio output signal from the acoustic output transducer and a body-conducted voice signal from a user of the hearing device, wherein the second input transducer is configured to pick-up sound signal comprising the body-conducted voice signal emanated from a mouth and/or a throat of the user, and transmitted through bony structures, cartilage, soft-tissue, tissue and/or a skin of the user;

extracting a voice signal, by the user voice extraction unit in the hearing device, based at least on the second input signal and the processed signal; and communicating the extracted voice signal to an external device by transmitting the extracted voice signal away from the user.

17. The hearing device according to claim 1, wherein the at least one external device comprises another hearing device.

18. The method according to claim 16, wherein the at least one external device comprises another hearing device.

* * * * *